US006527444B1

(12) United States Patent
Buchman

(10) Patent No.: US 6,527,444 B1
(45) Date of Patent: Mar. 4, 2003

(54) TAMPER-EVIDENT BAG HAVING ZIPPER-PROTECTIVE COVER AND METHODS

(75) Inventor: James E. Buchman, Hortonville, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 09/882,604

(22) Filed: Jun. 15, 2001

(51) Int. Cl.[7] ..... B65D 33/16

(52) U.S. Cl. ..... 383/36; 383/64; 383/904; 383/5; 383/204; 383/61.2

(58) Field of Search ..... 383/36, 5, 904, 383/63, 64, 204, 61.2

(56) References Cited

U.S. PATENT DOCUMENTS

| | | | | | |
|---|---|---|---|---|---|
| 2,273,128 | A | * | 2/1942 | Madsen et al. | 251/149.3 |
| 3,119,549 | A | * | 1/1964 | Schoen | 206/459.5 |
| 3,164,186 | A | * | 1/1965 | Weber et al. | 141/390 |
| 3,171,581 | A | * | 3/1965 | Kugler | 206/484 |
| 3,746,215 | A | * | 7/1973 | Ausnit et al. | 222/92 |
| 3,991,801 | A | | 11/1976 | Ausnit | |
| 4,191,230 | A | | 3/1980 | Ausnit | |
| 4,196,030 | A | * | 4/1980 | Ausnit | 156/244.11 |
| 4,235,653 | A | * | 11/1980 | Ausnit | 156/177 |
| 4,249,982 | A | * | 2/1981 | Ausnit | 156/204 |
| 4,285,376 | A | * | 8/1981 | Ausnit | 383/203 |
| 4,340,341 | A | | 7/1982 | Cardell | |
| 4,346,288 | A | | 8/1982 | Foster | |
| 4,437,293 | A | | 3/1984 | Sanborn, Jr. | |
| 4,657,792 | A | * | 4/1987 | Ausnit | 156/250 |
| 4,927,271 | A | | 5/1990 | Branson | |
| 4,951,666 | A | * | 8/1990 | Inman et al. | 383/111 |
| 5,030,113 | A | * | 7/1991 | Kramer | 383/36 |
| RE34,554 | E | * | 3/1994 | Ausnit | 383/63 |
| 5,519,982 | A | | 5/1996 | Herber et al. | |
| 5,584,580 | A | * | 12/1996 | Vetter | 383/5 |
| 5,713,669 | A | | 2/1998 | Thomas et al. | |
| 5,919,535 | A | * | 7/1999 | Dobreski et al. | 383/63 |
| 5,947,603 | A | * | 9/1999 | Tilman | 24/427 |
| 5,964,532 | A | * | 10/1999 | St. Phillips et al. | 383/203 |
| 6,012,844 | A | * | 1/2000 | Huseman et al. | 383/209 |
| D434,345 | S | | 11/2000 | Tomic | |
| 6,299,353 | B1 | * | 10/2001 | Piechocki et al. | 24/324 |

FOREIGN PATENT DOCUMENTS

| | | | |
|---|---|---|---|
| JP | 162247 | * | 7/1991 |
| JP | 3-162247 | | 7/1991 |
| WO | WO 00/28851 | | 5/2000 |

* cited by examiner

*Primary Examiner*—Stephen P. Garbe
(74) *Attorney, Agent, or Firm*—Julie E. Daulton; Tracey D. Beiriger

(57) ABSTRACT

A reclosable bag is provided that includes a reclosable mouth with a zipper and a slider device. The reclosable bag also includes a shield that covers the zipper such that when product is dispensed into the bag interior, the shield protects the zipper and prevents contact between the product and the zipper. In preferred arrangements, the shield includes an area of weakness to permit easy removal of the shield from the bag. Preferably, the shield is shaped to function as a funnel to help direct product into the bag interior, when filling. Preferred methods of using and constructing bags will utilize constructions as described herein.

11 Claims, 9 Drawing Sheets

TAMPER-EVIDENT BAG HAVING ZIPPER-PROTECTIVE COVER AND METHODS

TECHNICAL FIELD

This disclosure concerns bags, methods of using bags (including filling), and methods of constructing bags. In particular, this disclosure concerns bag constructions and methods including zippers and zipper-protective covers.

BACKGROUND

Flexible packages, in particular resealable and reclosable packages, are frequently used for packaging of consumable goods. Goods that are not used completely when the package is initially opened rely on a zipper closure to reclose the package and keep the remaining contents fresh. Examples of consumable goods that are often packaged in packages, such as bags, with a zipper closure include potting soil, fertilizer, pet food, dog biscuits, vegetables, cereal, and many different foods edible by humans. Often, the opening and closing of the zipper closure is facilitated by a slider device that is mounted on the zipper closure. The slider device is constructed to pry apart the interlocking zipper closure members when the slider device is moved in a first direction along the zipper, and to engage the interlocking zipper closure members when the slider device is moved in a second, opposite direction along the zipper. For some applications, a tamper-evident structure, to notify whether access has been gained to the zipper closure, is desired. Improvements in these types of packages are desirable.

SUMMARY OF THE DISCLOSURE

A reclosable bag is provided that includes a reclosable mouth with a zipper and a slider device. The reclosable bag also includes a shield that covers the zipper such that when product is dispensed into the bag interior, the shield protects the zipper and prevents contact between the product and the zipper. In preferred arrangements, the shield includes an area of weakness to permit easy removal of the shield from the bag.

Preferably, the shield is shaped to function as a funnel to help direct product into the bag interior, when filling.

Preferred methods of using and constructing bags will utilize constructions as described herein.

DETAILED DESCRIPTION

Figure 1:
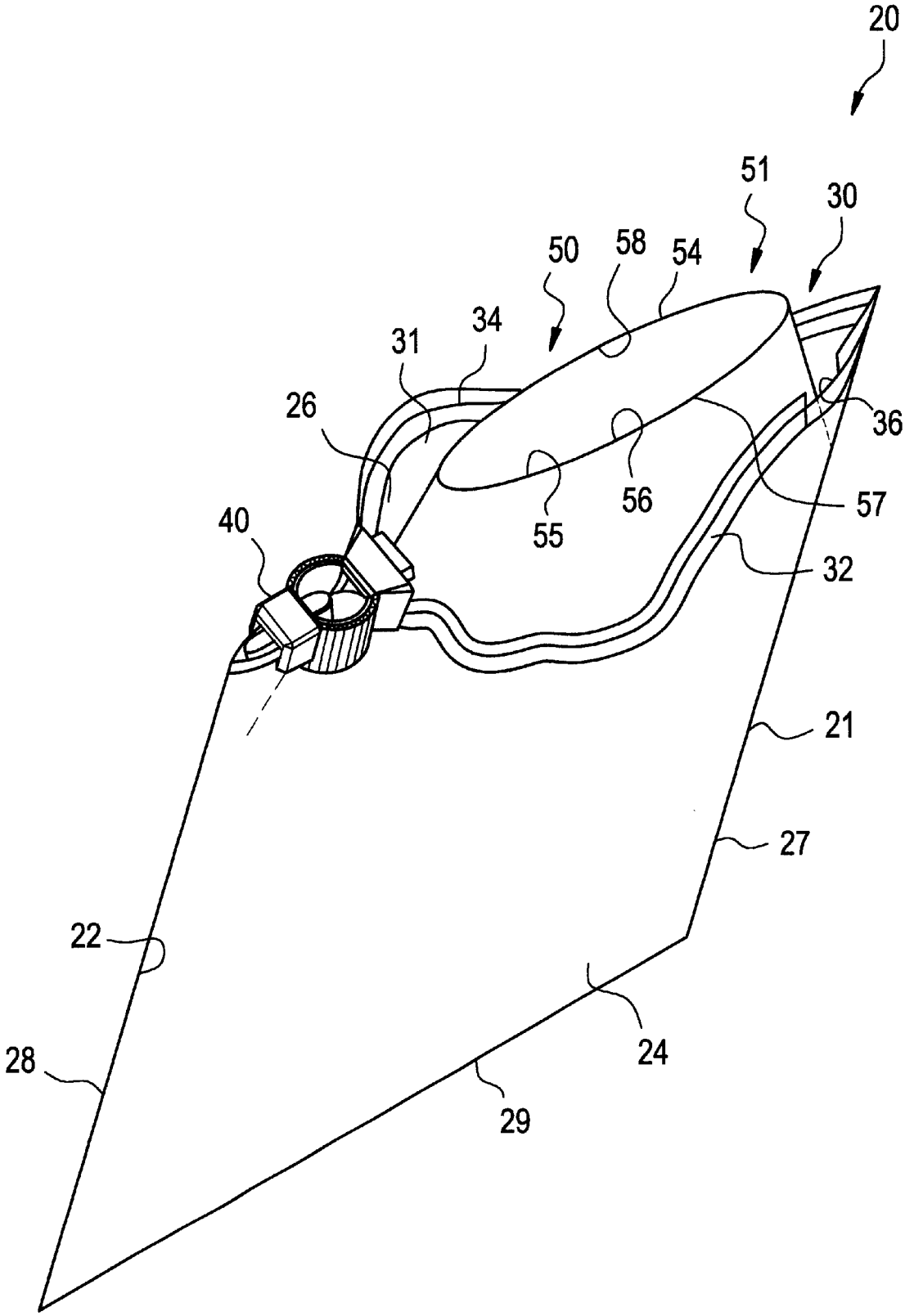
FIG. 1 is a schematic, perspective view of one embodiment of a bag, constructed according to principles of this disclosure.

A flexible, reclosable bag or package is shown generally in the FIGS. at 20. Bag 20 has a surrounding wall 21 defining an interior 22. In the depicted embodiment, surrounding wall 21 comprises first and second polymeric film side panels 24 and 26, which surround and define interior 22. Bag 20 includes three edges, side edges 27, 28, and product supporting bottom 29, to form interior 22 of package 20.

In FIG. 1, first side edge 27 and second side edge 28 are seals created by the application of heat and pressure to side panels 24, 26. Bottom edge 29 is a fold line between side panels 24, 26, which is formed when a single sheet of film is folded to form the two side panels 24, 26. In another embodiment, first and second panel sections 24, 26 are folded at side edges 27, 28 and heat-sealed at bottom edge 29; typically, such a package includes a fin seal (not shown) within one of panel sections 24, 26. In yet another embodiment, the panel sections 24, 26 are folded at one side edge, for example, first side edge 27, and heat-sealed at second side edge 28 and at bottom edge 29. Alternatively, two separate panel sections 24, 26 of plastic film may be used and heat-sealed together along both side edges 27, 28 and at the bottom edge 29.

A zipper closure arrangement 30 having mating closure profiles to open and close (unseal and reseal) the first and second side panels 24, 26 of package 20 extends at least partially between side edge 27 and side edge 28 at mouth 31. In FIG. 1, mouth 31 is disposed between side panels 24, 26 and provides access to the interior 22.

Figure 2:
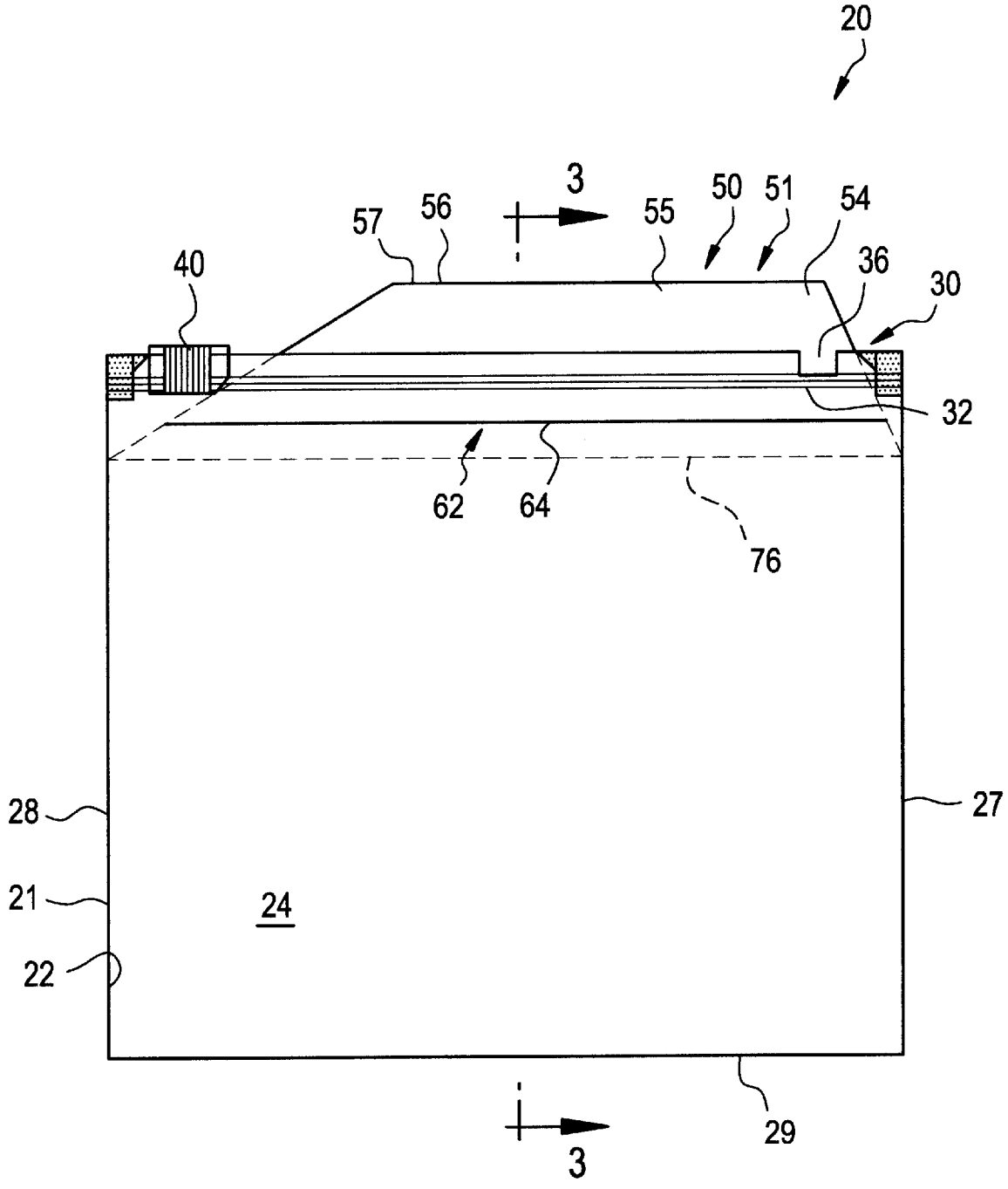
FIG. 2 is a schematic side elevational view of the bag of FIG. 1.
Figure 3:
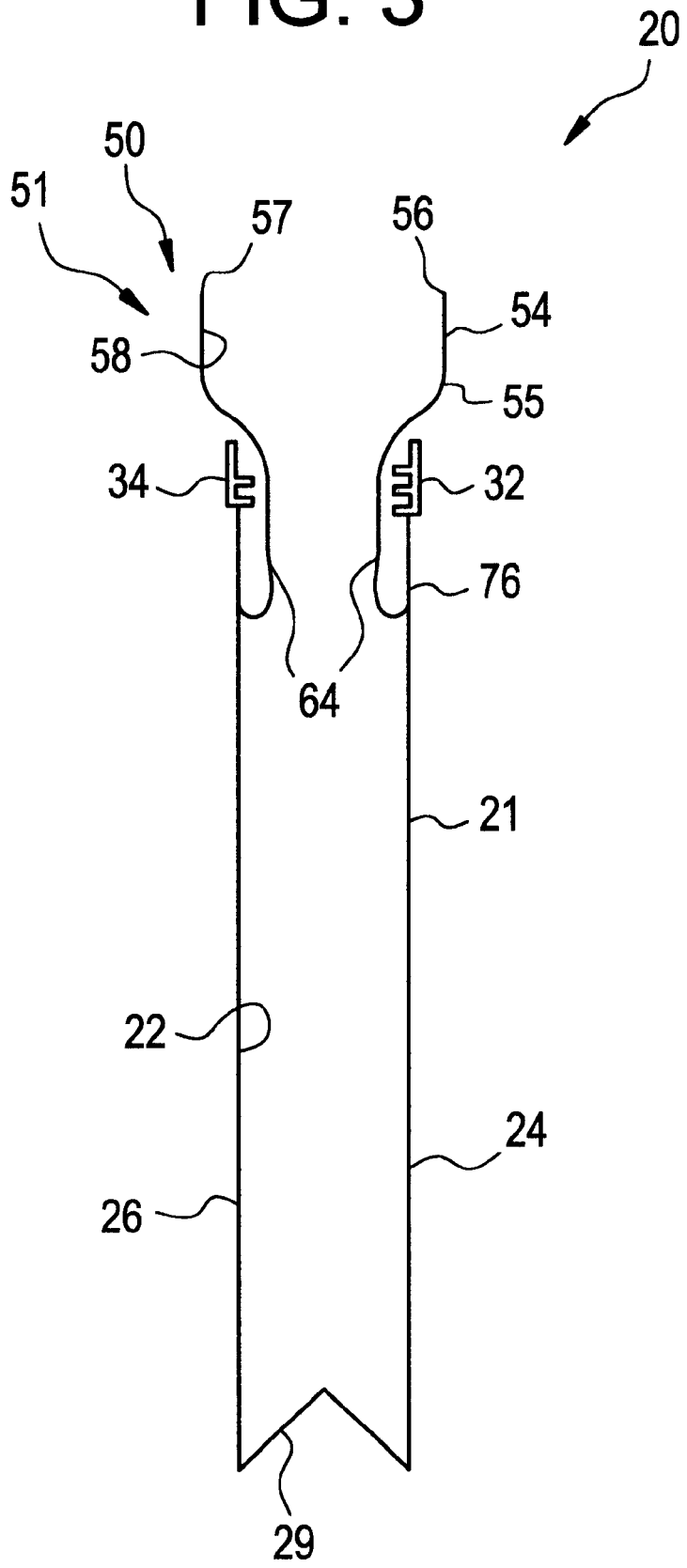
FIG. 3 is a schematic cross-sectional view of the bag of FIGS. 1 and 2, and taken along the line 3—3 of FIG. 2.

The zipper closure 30 can include a variety of configurations and structures. In FIG. 2, zipper closure 30 has a first closure profile 32 and a second closure profile 34; first and second closure profiles 32, 34 are releasably interlocking. Zipper closure 30 can be configured in many ways, for example, preferably such as disclosed in WO 00/28851 published May 25, 2000, or alternatively as shown in U.S. Pat. Nos. 4,340,341; 4,346,288; and 4,437,293; each of which is incorporated by reference herein. First closure profile 32 and second closure profile 34 engage and disengage, as appropriate, to open and close package 20 and provide access to interior 22.

A slider device 40 is mounted on zipper closure 30 to facilitate opening and closing of the mouth 31 by opening and closing the zipper closure 30; in particular, slider device 40 engages and disengages (interlocks and releases) first and second closure profiles 32, 34. A preferred slider device is taught in WO 00/28851 published May 25, 2000, and U.S. Pat. No. Des. 434,345 issued Nov. 28, 2000, each of which is incorporated herein by reference. A notch 36 is disposed within zipper closure 30. Notch 36 is designed to provide a "park place" into which slider device 40 settles when zipper closure 30 is sealed. The notch 36 decreases any tendency for an incomplete interlock between first closure profile 32 and second closure profile 34, when the slider is positioned therein.

The bag 20 also includes a zipper profile shield 50. In preferred embodiments, the shield 50 protects or shields the zipper profiles 32, 34 from being contaminated with product 52 (FIG. 7) when the bag interior 22 is filled with the product 52. The shield 50 also acts as a funnel 51, as can be seen best in FIG. 7, to direct the product 52 past the zipper construction 30 and the zipper profiles 32, 34 when the bag 20 is being filled.

In the particular one illustrated in the drawings, the shield 50 extends from the surrounding wall 21 inside of the outer enclosure and includes a partition 54. The partition 54 defines a free end 56 having a through hole or aperture 58 to permit the filling of the product 52 into the interior 22. As can be seen in FIGS. 1–8, the free end 56 extends outside of the outer enclosure of the surrounding wall 21.

As mentioned above, the shield 50 also acts as funnel 51. It can be appreciated that the funnel 51 is likewise secured to the surrounding wall 21 inside of the outer enclosure. The funnel 51 includes a filling end 57 and a funnel wall 55. The filling end 57 is analogous to the free end 56, while the funnel wall 55 is analogous to the partition 54.

The shield 50/funnel 51 is constructed and arranged to be removable from a remaining portion of the bag 20. Generally speaking, it will be desirable to remove the shield 50/funnel 51 after product 52 has been placed in the bag 20 and sealed within. In order to access the product 52 in the bag interior 22, the shield 50/funnel 51 will be removed from the bag 20 and it will permit access to the interior 22 and product 52. See FIG. 9.

In preferred embodiments, the shield 50/funnel 51 is removable from the bag 20 by way of an area of weakness 62 in the partition 54/funnel wall 55. The area of weakness 62 preferably comprises a tear line 64 that permits removal of the partition 54/funnel wall 55 easily therealong from the remaining portion of the bag 20. The tear line 64 can be a perforation line, a die line, and other types of areas of weakness to permit easy separation.

Figure 4:
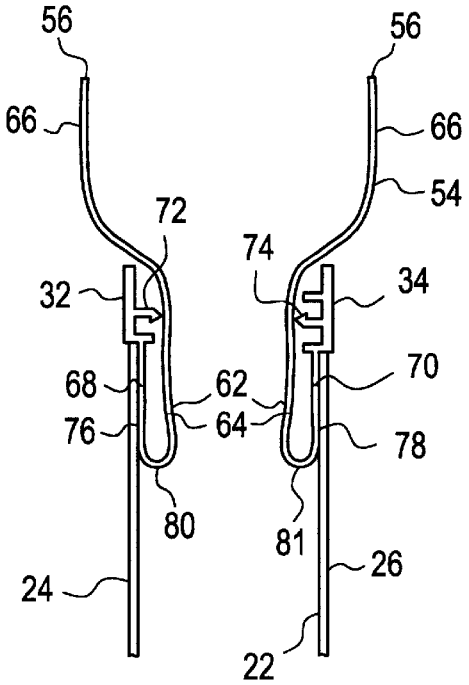
FIG. 4 is an enlarged, schematic, fragmented cross-sectional view of the zipper construction and protective shield utilized in the bag of FIGS. 1–3.

Preferably, the partition 54/funnel wall 55 is a plastic film 66, usually made from the same material as the panel sections 24, 26. The film 66 is securable to the bag 20 in a variety of fashions. In particular, attention is now directed to FIGS. 4–6, where three such examples are illustrated in schematic cross-section. In FIG. 4, the film 66 is integral with, and is merely an extension of, the first and second profiles 32, 34. In particular, each of the first and second profiles 32, 34 includes a mounting flange 68, 70 that extends from the interlocking profile members 72, 74 and toward the bag interior 22. As can be seen in FIG. 4, the film 66 is a continuous extension (typically an extrusion) from the mounting flanges 68, 70. This assembly of the zipper profiles 32, 34 with the integral film 66 is attached, typically by heat sealing, to the surrounding wall 21, illustrated as the first and second panel sections 24, 26. Thus, hermetic seals 76, 78 are formed between the mounting flanges 68, 70 and the panel sections 24, 26. As can be seen in FIG. 4, the film 66 is attached at the seals 76, 78 in the bag interior 22 and forms a bight section 80, 81 adjacent to the seals 76, 78. The film 66 then extends from the bight section 80, 81 past and over, in covering relation to, the zipper profiles 32, 34 to extend outside of the bag interior 22, terminating at the free end 56.

Figure 5:
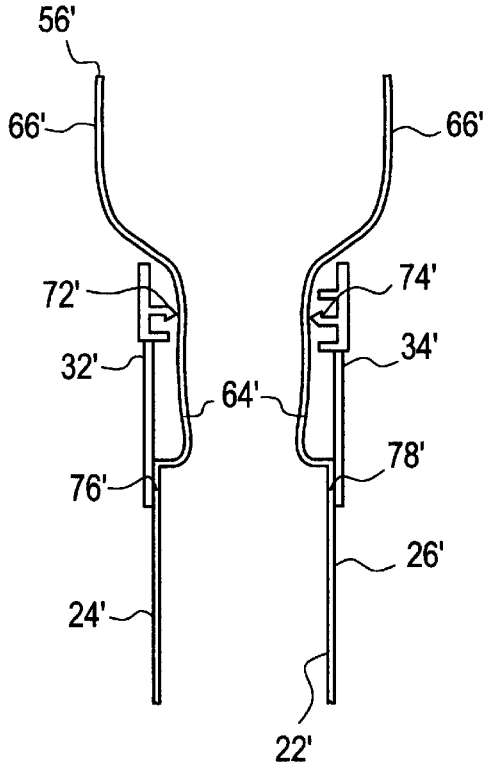
FIG. 5 is an enlarged, schematic, fragmented cross-sectional view of another embodiment of the zipper construction and protective shield utilized in the bag of FIGS. 1–3.

In FIG. 5, the film 66' is formed as an integral extension of, typically extrusion of, the surrounding wall 21, in particular, the first and second panel sections 24', 26' In this embodiment, the first and second profiles 32', 34' are secured to the panel sections 24', 26' at hermetic seals 76 , 78'. Adjacent to the seals 76', 78', the film 66' is spaced apart from to define a distance between the film 66' and each of the profiles 32', 34'. Note that the film 66' extends over in covering relation to the profile members 72', 74' Note that the film 66' terminates at free end 56' outside of the bag interior. The tear line 64' is depicted as being oriented between the interlocking zipper profiles 32', 34' and a bottom of the bag. The tear line 64' is also located between the seals 76', 78' and the profile members 72', 74'.

Figure 6:
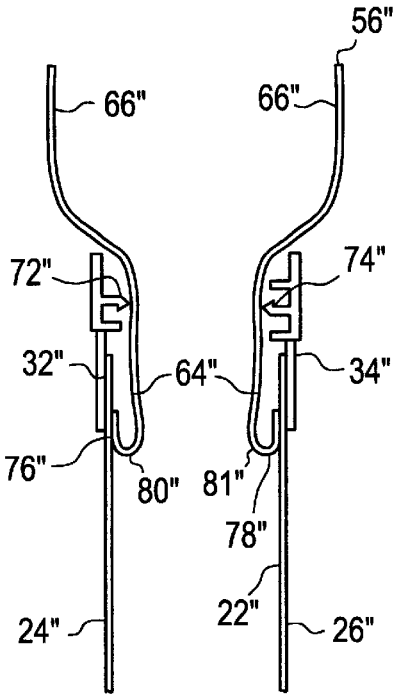
FIG. 6 is an enlarged, schematic, fragmented cross-sectional view of another embodiment of the zipper construction and protective shield utilized in the bag of FIGS. 1–3.

In FIG. 6, another way of securing the film 66" to the remainder of the bag is shown. In FIG. 6, the film 66" is a separate piece of film that is mechanically attached, such as by hermetic heat seals 76", 78" to the bag. In the particular way shown in FIG. 6, the film 66" is secured to the inner surface of the panel sections 24", 36". The first and second profiles 32", 34" are secured to the exterior of the panel sections 24", 26" with hermetic seals. As can be seen in FIG. 6, the film 66" extends from the seals 76", 78" down to a bight section 80", 81" and then after turning the bend formed by the bight sections 80", 81", extends past and over to cover and protect the profile members 72", 74". The film 66" terminates outside of the bag at free end 56". The tear line 64" is again positioned within the bag interior 22" and on the product side of the zipper profiles 72", 74".

In another embodiment, the bag walls can have the zipper profiles as a continuous, integral part thereof, with the film forming the shield 50/funnel 51 heat sealed thereto.

Figure 7:
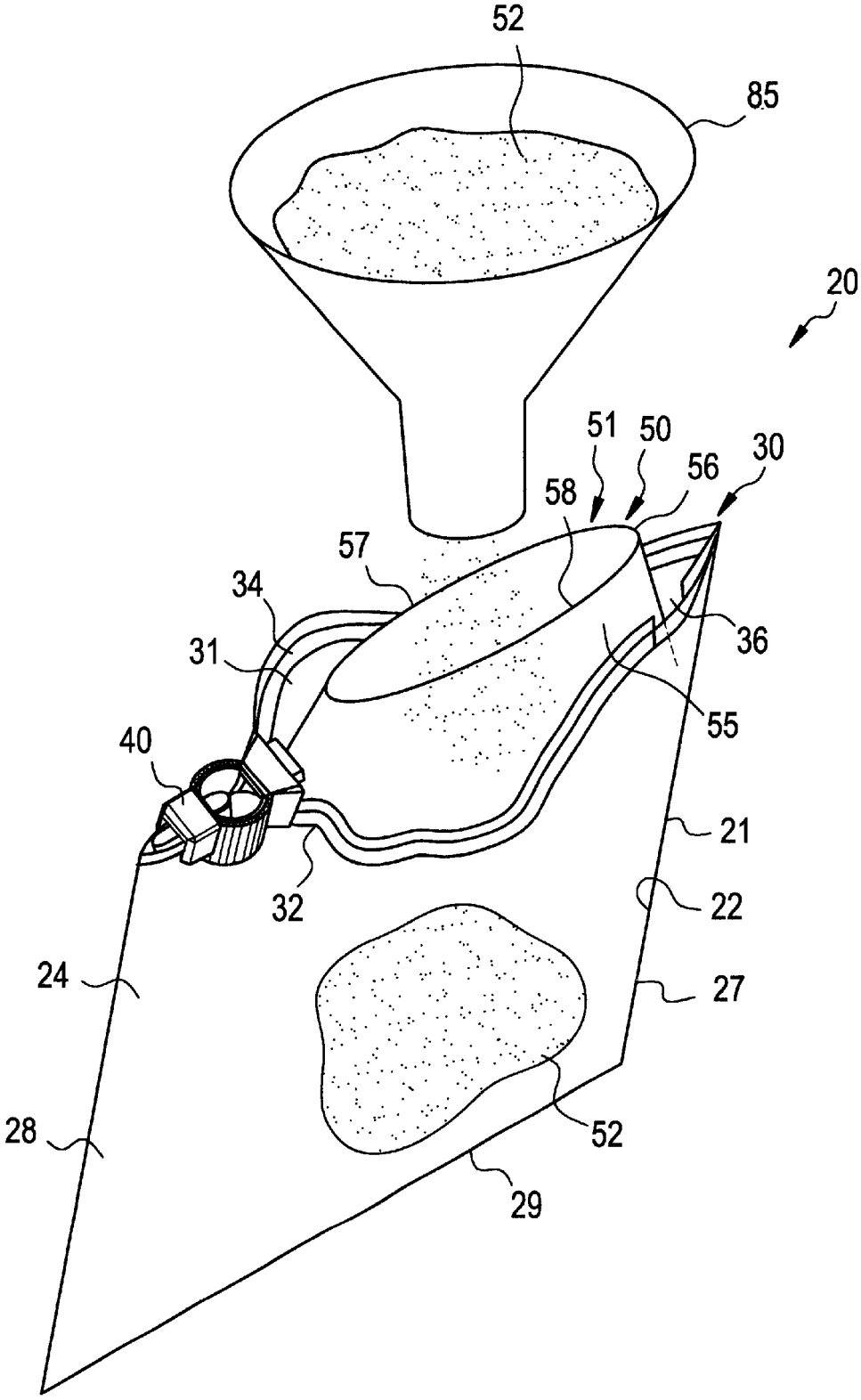
FIG. 7 is a schematic, perspective view of the bag of FIGS. 1–5 during a fill operation.

Use of the bag 20 may now be appreciated by reviewing FIGS. 7–10. FIG. 7 illustrates the bag 20 in a filling position, with a filling dispenser or hopper 85 filling the product 52 through the funnel 51. As can be seen, the product 52 is flowing through the filling end 57 (the aperture 58 of the partition 54). In some instances, the product 52 will be a particulate product that could normally clog or jam into the zipper profiles 32, 34. As the product 52 is flowing into the bag 20, it is being directed into the interior 22 past the zipper profiles 32, 34. The partition 54 funnel wall 55 is between the product 52 and the profiles 32, 34 to prevent product 52 from contacting the profiles 32, 34.

Figure 8:
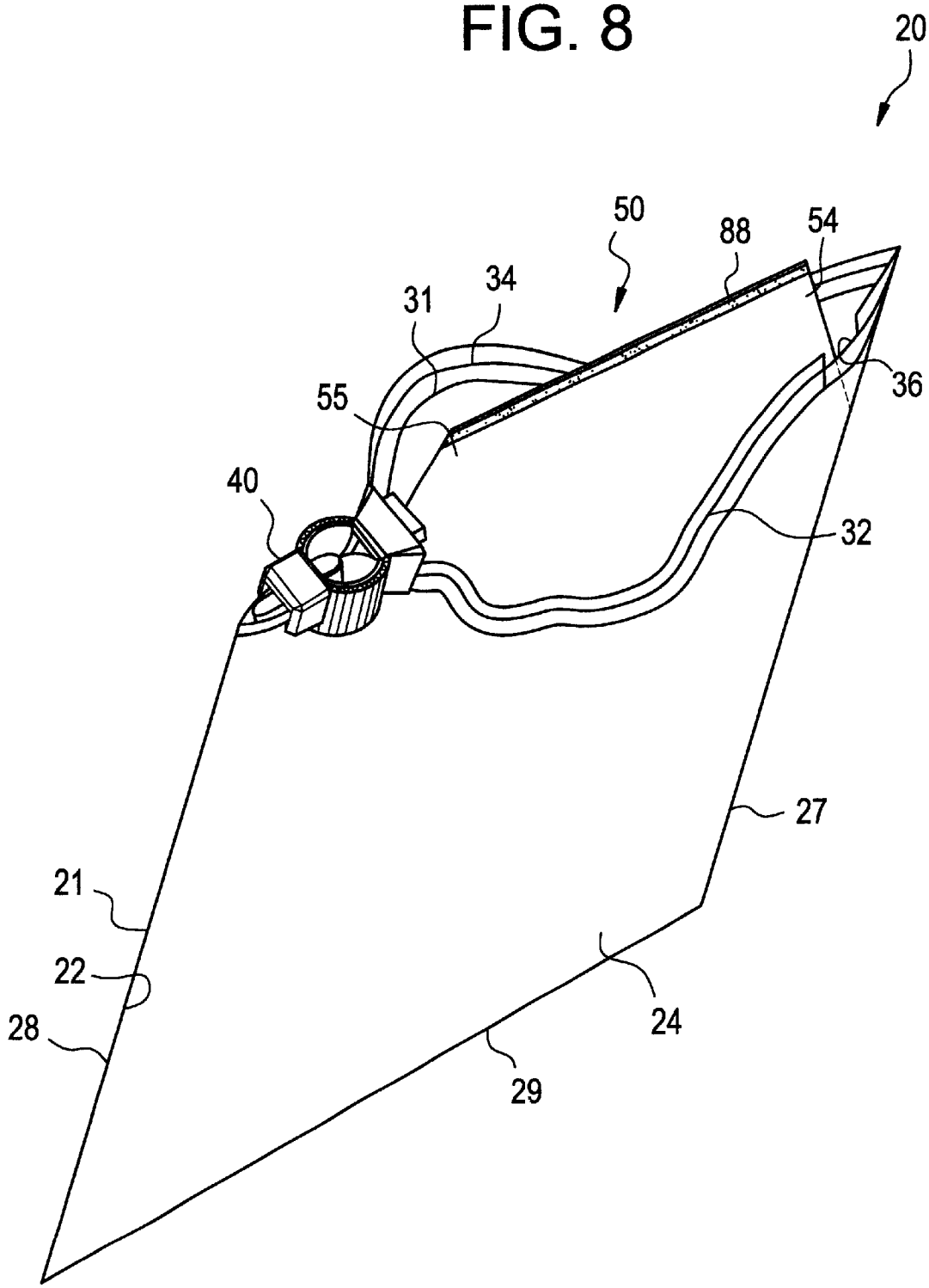
FIG. 8 is a schematic, perspective view of the bag of FIGS. 1–5 and 7 after filling and with the protective shield sealed closed.

After the step of filling the bag 20, a hermetic seal 88 is formed to close the aperture 58 of the filling end 57. This is illustrated in FIG. 8. This also results in a tamper-evident package. In other words, the user will be able to tell whether the package 20 has previously been opened.

Figure 9:
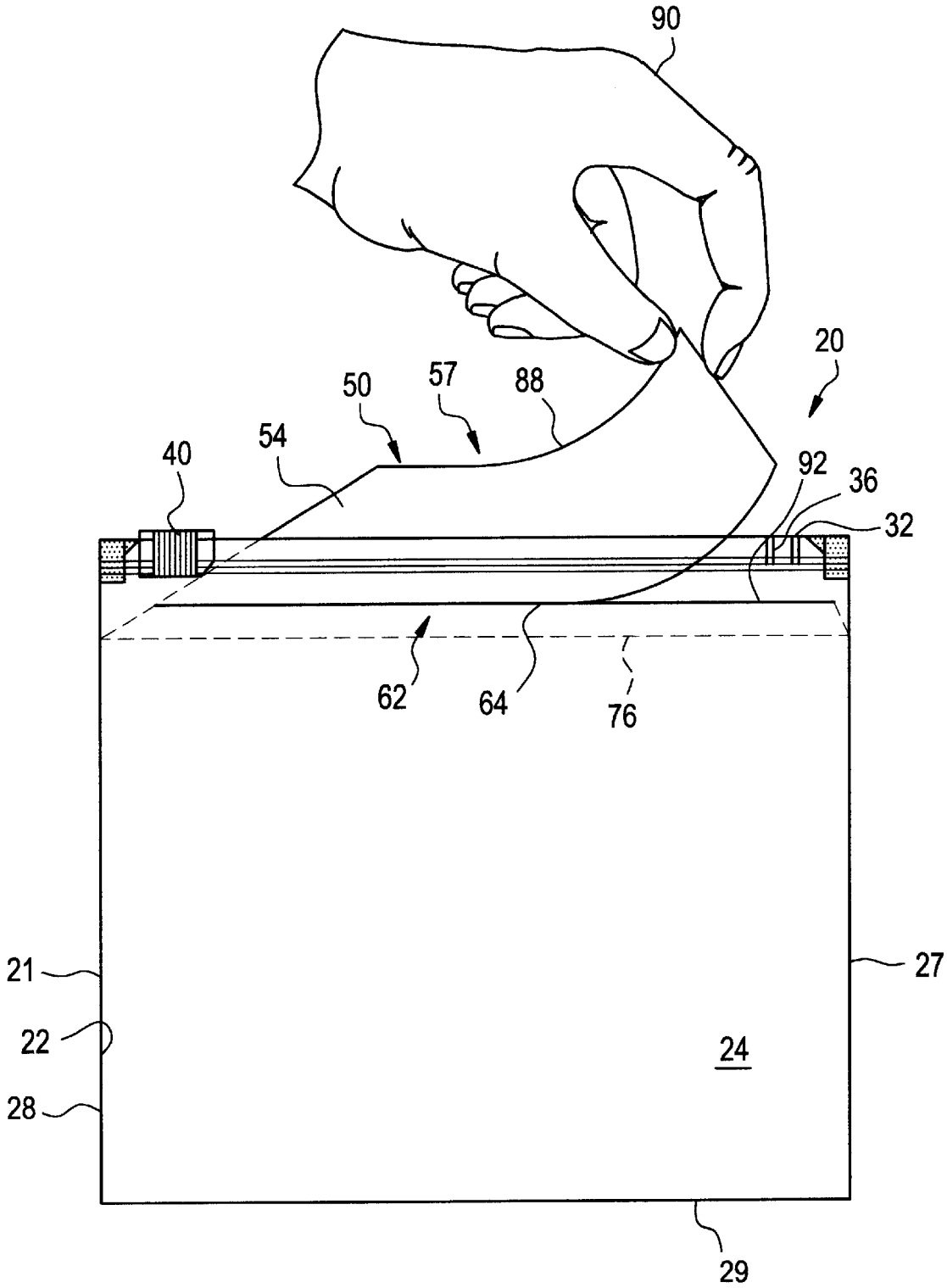
FIG. 9 is a schematic, side-elevational view of the bag of FIG. 8 showing the protective shield being removed from the bag.

In FIG. 9, a user's hand 90 is shown removing the shield 50/funnel 51 from the remainder of the bag 20 by grasping the partition 54/wall 55 and pulling it relative to the remainder of the bag 20. The partition 54/wall 55 will separate along the tear line 64 to leave a wall fragment 92. This results in the interior 22 being accessible to the user.

After the shield 50/funnel 51 is removed from the bag 20, the user may open and close the mouth 31 by operating the slider device 40 and moving it relative to the zipper construction 30. In this manner, the user may be able to selectively seal and unseal the bag 20 by operation of the slider device 40.

Figure 10:
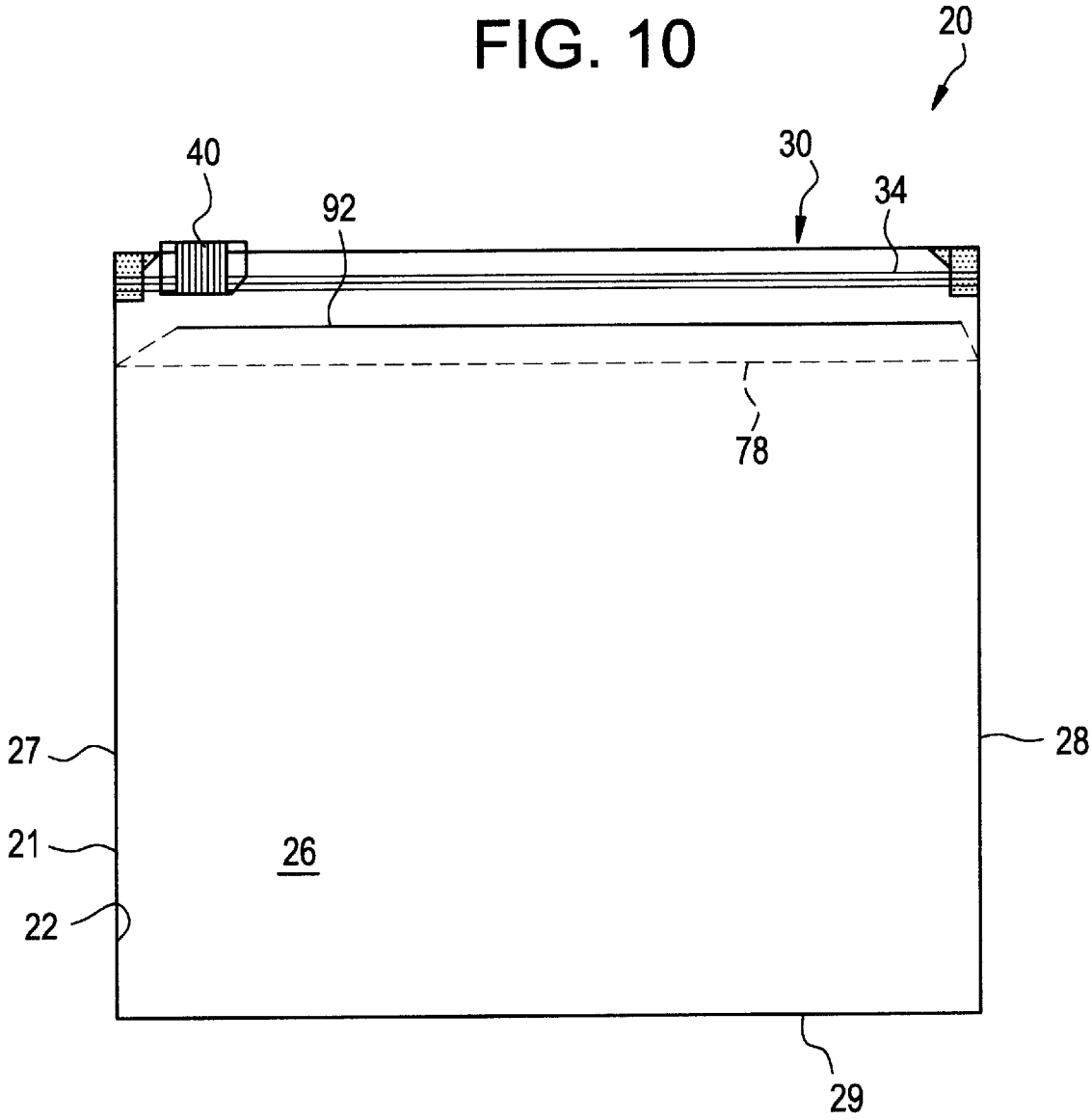
FIG. 10 is a schematic, side-elevational view of the bag of FIGS. 8 and 9, with the shield removed, and the zipper closed.

FIG. 10 illustrates the bag 20, after the shield 50/funnel 51 has been removed and the slider device 40 has been moved relative to the zipper construction 30 to close the mouth 31. The slider device 40, in FIG. 10, is positioned in the notch 36.

Figure 11:
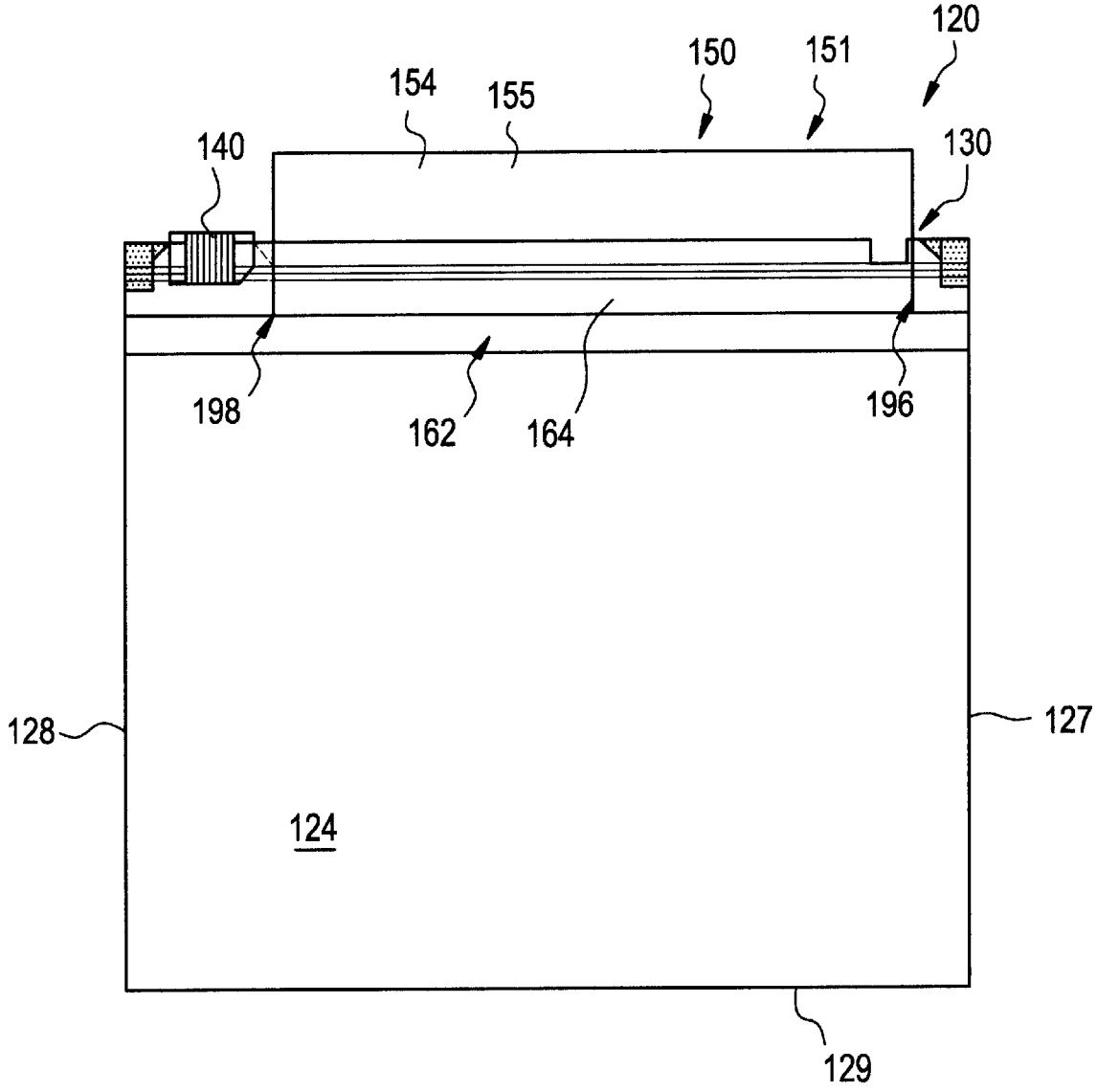
FIG. 11 is a schematic side elevational view of an alternate embodiment of the bag of FIG. 1.

FIG. 11 illustrates an alternate embodiment of the bag 120. The view in FIG. 11 is analogous to the view of FIG.

2. The bag 120 includes opposing panel sections 124 (the other not shown, but analogous to panel section 26, FIGS. 1, 3 and 10); side edges 127, 128; bottom portion 129; a zipper construction 130; slider device 140; and a shield 150/funnel 151. The shield 150/funnel 151 includes a partition 154/funnel wall 155. Each of these features functions analogously to the embodiment described above.

In this embodiment, the shield 150/funnel 151 has a rectangular shape instead of the trapezoidal shape illustrated in FIG. 2. This rectangular shape may be more attractive to the consumer, and it may be used as a product header, labeled with desired advertising or other media. Of course, the trapezoidal shape of FIG. 2 can also be used as a product header and be labeled with labels, advertising, media, trademarks, etc.

The partition 154/funnel wall 155 includes a pair of tear notches 196, 198 to assist the user in starting the tear to remove the shield 150/funnel 151 along the tear line 164 from the remainder of the package.

The bag 120 is used the same way as described for the embodiments of FIGS. 1–10.

What is claimed is:

1. A method of using a bag, the method comprising:

(a) providing a package including a surrounding wall portion defining an interior; a product-supporting bottom; a reclosable mouth opposing the product-supporting bottom; a funnel in the enclosure including a filling end and a funnel wall;

(i) the reclosable mouth including a zipper construction having opposing, selectively interlocking, profiles to selectively close and open said reclosable mouth;

(ii) the zipper construction having a slider device operably mounted thereon;

(iii) the funnel wall including a tear line oriented between the product-supporting bottom and said zipper profiles;

(b) orienting the filling end to a filling position outside of the package interior;

(c) at least partially filling the interior by dispensing a flowable product through the filling end into the funnel and directing the product along the funnel wall past the zipper construction without the product contacting the zipper profiles;

(d) sealing the filling end of the funnel; and (e) tearing the tear line along the funnel wall to access the product in the interior.

2. A method of using a bag according to claim 1 wherein:

(a) said step of tearing the tear line includes removing at least a portion of the funnel from a remaining portion of the bag.

3. A method of using a bag according to claim 2 further including:

(a) after said step of tearing the tear line, closing the mouth by sliding the slider device relative to the zipper construction to interlock the opposing profiles.

4. A method of using a bag according to claim 3 further including:

(a) after said step of closing the mouth, accessing the interior by sliding the slider device relative to the zipper construction to unlock the opposing profiles and open the mouth.

5. A reclosable bag comprising:

(a) an outer enclosure including a surrounding wall portion, a product-supporting bottom, and a reclosable mouth opposing the product-supporting bottom;

(i) the surrounding wall portion including first and second opposed panel sections;

(ii) said reclosable mouth including a zipper construction having opposing, selectively interlocking, profiles to selectively close and open said reclosable mouth;

(A) said zipper construction including a pair of mounting flanges extending from said opposing profiles;

(B) said zipper construction being secured to said first and second opposed panel sections by a hermetic seal between said mounting flanges and said first and second opposed panel sections;

(b) a slider device operably mounted on said zipper construction; said slider device constructed and arranged to interlock and separate said profiles to close and open said recloseable mouth, when said slider device is moved relative to said zipper construction;

(c) a zipper profile shield extending from the surrounding wall portion inside of the outer enclosure; the zipper profile shield including:

(i) a partition having a free end; the partition bang oriented to cover said zipper profiles with said free end extending outside of the outer enclosure;

(A) said partition including a tear line oriented between said product-supporting bottom and said zipper profiles, constructed and arranged to permit removal of at least a portion of said partition from a remainder of the bag; and (B) said partition being a continuous extension of a same piece of material of each of said first and second opposed panel sections.

6. A bag according to claim 5 further including:

(a) a flowable product held within tile outer enclosure; and (b) a seal closing said partition to prevent access to the outer enclosure.

7. A bag according to claim 5 wherein:

(a) said tear line comprises a perforation.

8. A bag according to claim 5 wherein:

(a) said tear line comprises an area of weakness.

9. A reclosable bag comprising:

(a) an outer enclosure including a surrounding wall portion, a product-supporting bottom, and a reclosable mouth opposing the product-supporting bottom;

(i) said reclosable mouth including a zipper construction having opposing, selectively interlocking, profiles to selectively close and open said reclosable mouth;

(ii) the surrounding wall including fist and second opposed panel sections;

(iii) said zipper construction including a pair of mounting flanges extending from said opposing profiles;

(iv) said zipper construction being secured to said first and second opposed panel sections by a hermetic seal between said mounting flanges and said first and second opposed panel sections;

(b) a slider device operably mounted on said zipper construction; said slider device constructed and arranged to interlock and separate said profiles to close and open said recloseable mouth, when said slider device is moved relative to said zipper construction;

(c) a funnel secured to the surrounding wall portion inside of the outer enclosure; the Funnel including a filling end and a funnel wall;

(i) said filling end defining an aperture arrangement and extending outside of said outer enclosure;

(ii) said funnel wall being oriented to direct a product past said zipper construction without the product contacting said zipper profiles when said filling end is in the outside of the enclosure and the reclosable mouth is open;

(A) said funnel wall including a tear line oriented between said product-supporting bottom and said zipper profiles; and (B) said funnel being a continuous extension of a same piece of material of each of said first and second opposed panel sections.

10. A bag according to claim 9 further including:

(a) a flowable product held within the outer enclosure.

11. A bag according to claim 9 further including:

(a) a seal closing said aperture arrangement of said filling end.

* * * * *

UNITED STATES PATENT AND TRADEMARK OFFICE

CERTIFICATE OF CORRECTION

PATENT NO. : 6,527,444 B1
DATED : March 4, 2003
INVENTOR(S) : James E. Buchman

It is certified that error appears in the above-identified patent and that said Letters Patent is hereby corrected as shown below:

Column 6,
Line 20, insert -- being -- delete “bang”.
Line 32, insert -- the -- delete “tile”.
Line 61, insert -- funnel -- delete “Funnel”.

Signed and Sealed this

Twenty-seventh Day of December, 2005

JON W. DUDAS
*Director of the United States Patent and Trademark Office*